US009322407B2

(12) United States Patent
Santoro

(10) Patent No.: US 9,322,407 B2
(45) **Date of Patent: *Apr. 26, 2016**

(54) CONTRA-ROTATING TRANSMISSION

(71) Applicant: JVS Associates, Inc., Port Washington, NY (US)

(72) Inventor: John Santoro, Port Washington, NY (US)

(73) Assignee: JVS Associates, Inc., Northport, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/591,371

(22) Filed: Jan. 7, 2015

(65) Prior Publication Data

US 2015/0226223 A1 Aug. 13, 2015

Related U.S. Application Data

(63) Continuation of application No. 14/176,452, filed on Feb. 10, 2014, now Pat. No. 8,951,012.

(51) Int. Cl.

| | |
|---|---|
| ***F04D 19/02*** | (2006.01) |
| ***F04D 19/00*** | (2006.01) |
| ***F04D 25/02*** | (2006.01) |
| ***F04D 25/06*** | (2006.01) |

(52) U.S. Cl.

CPC ..... *F04D 19/024* (2013.01); *F04D 19/007* (2013.01); *F04D 25/028* (2013.01); *F04D 25/06* (2013.01)

(58) Field of Classification Search

CPC ..... F16H 1/34; F16H 1/46; F04D 19/024; F04D 19/007; F04D 25/028; F04D 25/06

See application file for complete search history.

(56) References Cited

U.S. PATENT DOCUMENTS

| | | | |
|---|---|---|---|
| 1,428,661 | A | 9/1922 | Richardson |
| 1,902,374 | A | 3/1933 | Guglielmo |
| 1,914,797 | A | 6/1933 | Baker |
| 2,106,560 | A | 1/1938 | Barrett |
| 2,177,801 | A | 10/1939 | Arnold |
| 2,322,394 | A | 6/1943 | Sharpe |
| 3,083,893 | A | 6/1960 | Dean |
| 2,952,787 | A | 9/1960 | Moore |

(Continued)

FOREIGN PATENT DOCUMENTS

| | | | |
|---|---|---|---|
| FR | 2297336 | A1 | 8/1976 |
| JP | 60187796 | A | 9/1985 |

OTHER PUBLICATIONS

"Contra-Rotating Tube Axial Duct Fans", Stroble Air Corporation, Fans, Silencers and Systems, www.strobicair.com.

(Continued)

*Primary Examiner* — Craig Kim
*Assistant Examiner* — Maxime Adjagbe
(74) *Attorney, Agent, or Firm* — Katten Muchin Rosenman LLP

(57) ABSTRACT

According to at least one exemplary embodiment, an oil-free contra-rotating transmission is disclosed. The contra-rotating transmission may comprise a lower drive unit; and an upper drive unit, wherein the lower drive unit receives power from a motor and is configured to (i) transfer power from the motor to the upper drive unit, and (ii) rotate a first axial fan in a first direction. The upper drive unit may be configured to rotate the second axial fan in a second direction opposite to the direction of rotation of the first direction.

20 Claims, 10 Drawing Sheets

(56) References Cited

U.S. PATENT DOCUMENTS

| | | | | |
|---|---|---|---|---|
| 3,337,122 | A | 8/1967 | Gross | |
| 3,900,301 | A | 8/1975 | Constantinescu et al. | |
| 4,077,273 | A | 3/1978 | Osborn | |
| 4,842,484 | A | 6/1989 | Johnson | |
| 4,883,240 | A | 11/1989 | Adamson | |
| 5,087,230 | A | 2/1992 | Yates et al. | |
| 5,795,200 | A | 8/1998 | Larkin | |
| 6,540,570 | B1 | 4/2003 | Eakin | |
| 6,565,334 | B1 | 5/2003 | Bradbury | |
| 8,111,028 | B2 | 2/2012 | Rollins | |
| 8,152,679 | B2 | 4/2012 | Sappenfield | |
| 8,460,146 | B2 | 6/2013 | Imase | |
| 8,951,012 | B1 * | 2/2015 | Santoro | 416/128 |
| 2001/0036406 | A1 | 11/2001 | Illingworth | |
| 2006/0093482 | A1 | 5/2006 | Wacinski | |
| 2008/0056897 | A1 | 3/2008 | Anderson | |
| 2008/0181804 | A1 | 7/2008 | Tanigawa et al. | |
| 2011/0142611 | A1 | 6/2011 | Kato | |
| 2011/0174011 | A1 | 7/2011 | Kim | |
| 2011/0312264 | A1 | 12/2011 | Kim et al. | |
| 2012/0099988 | A1 | 4/2012 | Charier | |

OTHER PUBLICATIONS

"TDC Series Contra-Rotating Axial Fans", Kruger Ventilation Industries PTE LTD.

Transmittal; International Search Report; and Written Opinion of the International Searching Authority for International Application No. PCT/US2013/070430, with a mailing date of Apr. 15, 2014.

* cited by examiner

CONTRA-ROTATING TRANSMISSION

CROSS REFERENCE TO RELATED APPLICATIONS

This application is a continuation of U.S. patent application Ser. No. 14/176,452, filed on Feb. 10, 2014, entitled "Contra-Rotating Axial Fan Transmission For Evaporative And Non-Evaporative Cooling & Condensing Equipment" by John Santoro, which is hereby incorporated by reference.

FIELD OF THE INVENTION

The present invention is directed to systems, methods and arrangements for providing contra-rotating axial fans, and fan drive systems. More specifically, the present invention is directed to axial fans and fan drive systems for evaporative ("WET") & non-evaporative ("DRY") cooling equipment, as well as heating, ventilation, air conditioning, industrial processes, and/or refrigeration condensers. More specifically, the present invention is directed to axial fan drive assemblies for evaporative, air, water, and hybrid wet/dry cooling equipment. Even more specifically, the present invention is directed to an oil-free contra-rotating axial fan transmission.

BACKGROUND OF THE INVENTION

The present invention is directed to axial fans and fan drive systems for evaporative, air, water, and hybrid wet/dry cooling equipment. Common applications for evaporative cooling equipment, such as cooling towers, include providing cooled process medium for heating, ventilation, air conditioning, and refrigeration ("HVACR"), manufacturing, industrial processes, and electric power generation. In operation, the cooling towers serve to transfer heat from the process medium into the surrounding environment. Similarly, common applications for non-evaporative cooling equipment, such as condensers, include providing cooled process medium for HVACR, manufacturing, industrial processes and electric power generation. Finally, common applications for hybrid cooling equipment, such as wet/dry closed circuit coolers, include providing cooled process medium for HVACR, manufacturing, industrial processes, and electric power generation. Generally speaking, as is generally known in the art, WET/DRY cooling equipment serve to transfer heat from the process medium into the surrounding environment. Such WET/DRY cooling equipment may be a standalone piece of equipment or a part of a larger "packaged" piece of HVACR or industrial equipment.

In an open circuit cooling tower, the process fluid to be cooled is delivered to the cooling tower and is typically distributed by a series of nozzles that atomize the process fluid over a heat transfer medium located inside the heat exchanger section, commonly referred to as a "fill." The fill facilitates heat transfer by promoting evaporation through commingling the process fluid with dry, outside air. The fill provides a large surface area and facilitates contact between the process fluid and the dry, unsaturated airstream supplied by a fan within the cooling tower. As the process fluid droplets pass through the fill, heat is transferred to the atmosphere through the discharge airstream of the cooling tower. A portion of the process fluid is lost through the endothermic process of evaporation, leaving the remaining process fluid at a lower temperature than it was before it entered the cooling tower. The cooled process fluid is collected in a collection basin at the bottom of the cooling tower and then withdrawn therefrom.

Closed-circuit cooling towers, also known as fluid coolers, have similar functionality, with a difference being that the process fluid is contained within one or more heat transfer coils and not directly exposed to the surrounding environment. Water stored in the collection basin of the unit is typically sprayed over the coil(s) to promote heat transfer from the liquid to the make-up water, while at the same time promoting the endothermic process of evaporation. The end result is the process fluid within the coil is cooled through evaporation of spray water on the outside surface of the coil, and to a lesser degree, heat is transferred through the temperature gradient between the spray water/intake air temperature and the coil when atmospheric conditions allow.

Evaporative condensers are nearly identical to a closed-circuit cooling tower, or fluid cooler, except for the process medium. In the case of an evaporative condenser, the process medium is a refrigerant delivered directly from the evaporator of an HVACR machine. The evaporative condensers are typically used in the refrigeration industry, cold storage, ice skating rinks, cryogenics, and so forth. Hybrid versions of closed-circuit cooling towers employ the addition of fins to the coil circuits similar in design to those employed on air cooled condensers and heat exchangers. Where atmospheric conditions and/or systems load conditions allow, the fluid cooler is switched from the conventional evaporative, a.k.a "wet operation," cooling mode to an air-cooled, a.k.a. "dry operation," by switching off the spray water pump. This effectively changes the machine from a closed-circuit cooling tower into an air-cooled condenser/heat exchanger. The purpose of these hybrid cooling units is to save water and energy by arresting the evaporation of water and the elimination of the energy required to operate the spray water pump when atmospheric conditions and system load conditions allow.

Non-evaporative condensers and coolers have similar functionality to closed-circuit cooling towers with the difference being that they rely solely on heat transfer through direct and/or indirect contact of the process medium and the heat exchanger surface with outside air. Non-evaporative condensers and coolers have similar construction and component arrangements to closed-circuit cooling towers with a difference being that they omit components associated with evaporative cooling process, such as, but not limited to, spray water pump, distribution systems, drift eliminators, and collection basins. Air-cooled condensers and coolers use heat exchangers of the "Liquid to Air" or "Gas to Air" variety, while and water-cooled condensers and coolers use heat exchangers of the "Liquid to Liquid" or "Gas to Liquid" variety, which is similar in design and construction to those employed in closed-circuit cooling towers.

In operation, airflow through WET/DRY cooling equipment is typically facilitated by a fan in combination with an intake air conduit and an exhaust air conduit, which are provided for each heat transfer section, unit, or cell, of the equipment. In induced-draft equipment, the fan is typically mounted near the exhaust of the unit and used to draw air from the intake through the interior of the unit and across the heat exchange surface located inside the heat exchanger section. In forced-draft equipment, the fan is typically mounted near the intake and pushes the air through the interior of the cooling unit, across the heat exchange surface located inside the heat exchanger section and out via the exhaust.

Several considerations are present during the installation and design WET/DRY cooling systems, including airflow, sound output, space requirements, energy requirements, and vibration transmission. It is desirable to minimize noise emitted by operation of the fan, the energy consumed by the fan drive system, and the vibrations emitted by the fan drive system. However, minimizing these negative attributes requires reducing the rotational speed of the fans, which limits the heat exchange capacity of a given unit design by falling below the required minimum airflow and static pressure. Independent of minimizing negative attributes of the conventional axial fan systems currently in use, it is also desirable to employ a fan arrangement with a higher overall efficiency that can generate an increased amount of airflow and static pressure at a given energy input value. Such a fan arrangement would increase the thermal capacity ratings, and energy efficiencies of existing WET/DRY cooling equipment designs, while at the same time increasing the energy efficiency of the entire heat transfer system in which they are installed.

As disclosed herein, one solution to minimize the negative attributes and/or increase thermal capacity ratings and energy efficiencies of WET/DRY cooling equipment is the use of a contra-rotating, multi-stage fan arrangement. A contra-rotating, multi-stage fan arrangement is capable of meeting minimum airflow and static pressure requirements at rotational speeds that are lower than that of currently-employed axial fan systems. A contra-rotating, multi-stage fan arrangement is also capable increased airflow and static pressure at a given energy input than that of currently-employed axial fan systems.

BRIEF SUMMARY OF THE INVENTION

The present invention provides contra-rotating axial fan systems. The present invention also provides a contra-rotating axial fan system and contra-rotating transmission for use in HVACR condensers and/or evaporative cooling equipment.

According a first aspect, a contra-rotating axial fan system comprises: a first axial fan disposed in an air conduit; a second axial fan disposed in the air conduit and arranged coaxially with first axial fan; a transmission, the transmission comprising of two main assemblies; lower drive assembly and an upper drive assembly; wherein the lower drive assembly is configured to receive power from a motor and is configured to (i) transfer power to the upper drive assembly and (ii) rotate the first axial fan in a first direction; wherein the upper drive assembly is configured to rotate the second axial fan in a second direction; wherein the direction of rotation of the first direction is opposite to the direction of rotation of the second direction. The lower and upper drive assemblies may be housed in separate enclosures and coupled externally, housed in a common enclosure internally coupled, fully integrated into a single assembly housed in a single enclosure, or one or both assemblies integrated within an axial fan hub and/or fan motor.

According a second aspect, a contra-rotating transmission comprising: a lower drive assembly; and an upper drive assembly, wherein the lower drive assembly is configured to receive power from a motor and is further configured to (i) transfer power to the upper drive assembly and (ii) rotate a first axial fan in a first direction; wherein the upper drive assembly is configured to rotate the second axial fan in a second direction; wherein the direction of rotation of the first direction is opposite to the direction of rotation of the second direction.

In certain aspects, the speed of rotation of the first axial fan may be different from the speed of rotation of the second axial fan.

In certain aspects, the lower drive assembly may comprise a center pinwheel driver, an outer pinwheel receiver, and a first plurality of intermediate pinwheels that simultaneously engage both the center pinwheel driver and outer pinwheel receiver.

In certain aspects, the upper drive unit may comprise a center pinwheel receiver, and a second plurality of intermediate pinwheels. In certain embodiments, the upper drive unit may further include a second outer pinwheel receiver, which may be employed when a separate housing is used.

In certain aspects, each of said first plurality of intermediate pinwheels may be operatively coupled to a corresponding one of said second plurality of intermediate pinwheels.

In certain aspects, said first plurality of intermediate pinwheels and said second plurality of intermediate pinwheels may be configured to rotate at the same revolutions per minute.

In certain aspects, the center pinwheel driver, the outer pinwheel receiver, and the first plurality of intermediate pinwheels may be in a multi-phased arrangement (e.g., a dual-phased arrangement), whereby the layers of which may be offset with respect to one another, whereby each is rotated by a predetermined number of degrees.

In certain aspects, the center pinwheel receiver, and the second plurality of intermediate pinwheels may be in a multi-phased arrangement (e.g., a dual-phased arrangement), whereby the layers of which may be offset with respect to one another, whereby each is rotated by a predetermined number of degrees.

In certain aspects, said first axial fan and said second axial fan may be disposed in an air conduit of an evaporative equipment unit and arranged coaxially with respect to one another.

In certain aspects, each of said first and second plurality of intermediate pinwheels may comprise two or more disks separated by a plurality of perpendicularly-disposed rollers, wherein each roller may comprise a center pin and a hollow cylinder rotationally-arranged around said center pin. In certain aspects, the air conduit may be an air discharge conduit or an air intake conduit.

In certain aspects, the contra-rotating transmission is oil-free. In certain aspects, the contra-rotating transmission may employ a sealed case and grease lubrication.

BRIEF DESCRIPTION OF THE FIGURES

These and other advantages of the present invention will be readily understood with reference to the following specifications and attached drawings, wherein.

DETAILED DESCRIPTION OF THE INVENTION

Figure 1A:
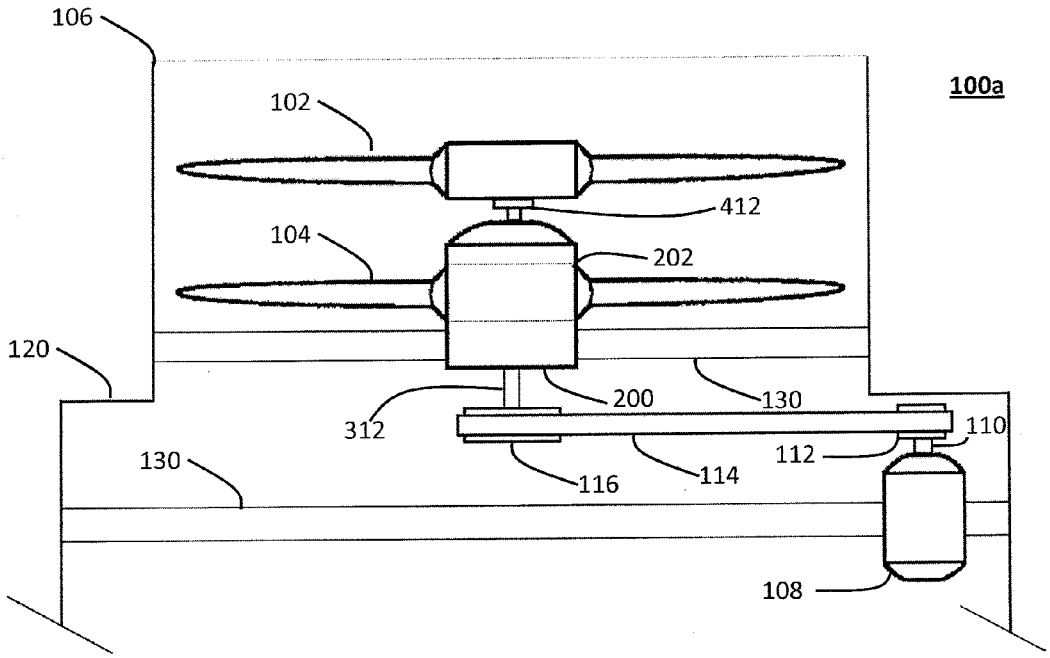
FIG. 1*a* is an exemplary embodiment of a first contra-rotating axial fan system for evaporative cooling equipment.

Embodiments of the present invention will be described hereinbelow with reference to the accompanying drawings. Alternate embodiments may be devised without departing from the spirit or the scope of the invention. In the following description, well-known functions or constructions are not described in detail because they would obscure the invention in unnecessary detail. Further, to facilitate an understanding of the description, discussion of several terms used herein follows.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

As used herein, the term "input shaft" shall be understood to refer to any device that applies torque to the transmission (e.g., a contra-rotating transmission so as to initiate and/or maintain rotation of the transmission gearing arrangement (s)).

As disclosed herein, a multi-stage axial fan system may be configured to enable contra-rotation, as well as co-rotation, of two or more axial fans. Indeed, multi-stage axial fan systems may deliver and reap the benefits of co- and contra-rotating, multi-stage axial fan systems, including, but not limited to, altering static pressure, flow rate, horsepower ("HP") consumption, fan system efficiency, sound, harmonics, thermal efficiency of cooling unit (e.g., an evaporative cooling unit or HVACR system), thermal performance of cooling unit, layout, and sound quality of cooling unit, etc.

Employing a pair of coaxial axial fans (e.g., coaxial contra-rotating axial fans), in lieu of a single fan, provides a number of advantages. For instance, a pair of contra-rotating axial fans can produce a higher cubic foot per minute ("CFM") output while maintaining minimum static pressure required for air to travel from intake to discharge in evaporative cooling equipment and air- or water-cooled equipment, thus increasing the amount of heat exchanged from the process fluid to the waste airstream. Accordingly, a pair of contra-rotating axial fans provides greater thermal efficiency in terms of total heat rejection typically measured in British Thermal Units per Hour ("BTUh"). Thus, the axial fan system provides increased thermal and/or energy efficiency.

Indeed, employing a pair of contra-rotating axial fans enables evaporative cooling equipment manufacturers to substantially increase and maximize thermal capacity in existing or new coil products by utilizing a denser coil design, thereby allowing for more surface area in a given coil space volume. The surplus static pressure generated by contra-rotating axial fans also allows for the use of larger coils with, or without, increased fins per inch ("FPI") and coil rows that can carry larger pressure drops than existing equipment, thus increasing the thermal capacity of air-cooled equipment in every coil, cross-sectional area size currently in use. Additional opportunities for thermal capacity increases can be realized due to the present axial fan system's allowance for the use of denser and higher performance heat transfer mediums with higher associated pressure drops. In addition, this arrangement allows the use of increased air travel in heat exchange sections than those that are currently being used.

In other words, contra-rotating axial fans enable the system to generate large amounts of static pressure at a given power input, while maintaining minimum airflow requirement, thereby creating the opportunity to utilize the surplus static pressure advantageously in WET/DRY cooling equipment design. In a contra-rotating configuration, one fan is primarily responsible for the increase in static pressure while the other fan is primarily responsible for the general air flow. For example, a leading fan maybe primarily responsible for air flow (moving air), while the leaving fan is mainly responsible for generating static pressure (compressing air). The surplus static pressure generated by the contra-rotating fan system allows for the use of higher performance components with higher pressure drops, including, but not limited to, the components discussed previously in detail. This may be accomplished using the same amount of (or less) power to the motor (e.g., a 10 HP motor) depending on the goals for a given piece of equipment (low sound, efficiency, layout footprint, layout height, layout restrictions, etc.).

An example use of the resulting surplus static pressure includes the ability to increase the heat transfer surface area by utilizing larger heat exchanger sections with increased air travel, which is not possible with single stage and co-rotating multi-stage axial fan systems. The surplus static pressure is used to overcome the higher pressure drop across the heat exchanger section as the overall air travel of the heat exchanger section is increased.

When it is not advantageous to use heat exchanger sections with increased air travel (for reasons such as dimensional constraints, manufacturing costs, etc.), the surplus static pressure can alternatively be utilized by increasing the amount of heat transfer surface area in a given heat exchanger section at the expense of pressure drop across the heat exchanger section. For example in air- and/or water-cooled condensers, the density of coil fins can be increased and/or the coil surface area may be increased by more densely packing the existing coil frame. Coil finning is rated in the industry as FPI. This concept is also true for cooling units that utilize finned coils such as hybrid wet/dry coolers and more increasingly standard, closed-circuit cooling towers.

Evaporative cooling equipment that does not use a coil can take advantage of the surplus static pressure by increasing the air travel (drift) of the heat transfer medium's surface (e.g., the fill). Alternatively or conjunctively the heat transfer medium's surface can be more densely packed to provide more heat transfer surface area at the expense of pressure drop across the heat exchange medium.

Yet another possible way to take advantage of the surplus static may be to use drift eliminators of a denser design with larger pressure drop that would allow the maximum amount of airflow in a given heat exchanger size to be increased without forcing the process medium to be ejected out of the air discharge. Current industry maximum counter-flow rate velocities are approximately 800 feet per minute (FPM).

The ability to utilize heat exchanger sections with increased air travel leads to the opportunity to increase thermal capacity in any given cross-sectional area or "footprint" of the WET/DRY cooling equipment. In the evaporative cooling industry this is also referred to as "box size." Thus, the increase in efficiency stemming from using a pair of contra-rotating axial fans provides the user a thermal "box advantage." That is, a user can deliver the same output using evaporative cooling equipment having a smaller footprint, or, in the alternative, provide increased output without requiring larger footprint, cooling equipment. This is particularly pertinent when the footprint of the evaporative cooling equipment is a consideration or limitation (e.g., in urban areas). For example, HVAC systems installed in tall buildings require a great amount of cooling capacity, but provide limited rooftop space for mechanical equipment (e.g., building ventilation equipment, exhaust flues, elevator equipment, window-washing equipment, etc.). Similarly, such configurations allow for evaporative cooling equipment to be placed closer to solid objects, making it more suitable for tight layouts, and reducing the minimum requirement for overall air intake sizes allowing for reduction in height opportunities on counter-flow-induced-draft units. Counter-flow-induced-draft units are typically taller than other configurations due to the air intake at bottom of the equipment. However, the air intakes can be shortened at the expense of pressure drop by use of surplus static pressure, thus shortening the overall height of the equipment.

Finally, a contra-rotating axial fan system can also be configured with standard axial fans that operate at a lower rotation per minute ("RPM"), as opposed to specialized axial fans, which are often utilized by evaporative cooling equipment manufacturers. That is, specialized axial fans may be specifically engineered to produce minimum design CFM and static pressure at the lowest possible RPM. However, enabling the contra-rotating axial fan system to operate with standard axial fans allows evaporative cooling equipment manufacturers to utilize inventory standard fans in lieu of having to stock two or more types of fans to accommodate low-sound projects. In addition, specialized axial fans (e.g., engineered, low-RPM fans, tandem blade) are typically more than double the cost of standard fans. Generally, the lower the RPM of a fan system, the lower the sound power level generated. The sound power level difference between two identical fan systems running at different RPMs is described by the following equation:

$$\text{Sound Power Level Difference} = 20\log_{10}\left(\frac{RPM\ \text{System \#1}}{RPM\ \text{System \#2}}\right)^{2.5}$$

The surplus static pressure, as described previously, can also be applied to the use of more substantial sound attenuators with higher pressure drops that are unable to be used with current fan systems, further enhancing the low sound capabilities of the equipment utilizing this fan arrangement.

Fans may be selected (e.g., by cooling equipment manufactures) utilizing fan manufacturer-provided fan curves or fan manufacturer selection software that generates fan curves. Indeed, the cooling equipment manufacturer determines the minimum pressure drop for a particular piece of equipment, minimum/maximum fan diameter for use with the equipment, maximum allowable air flow, and the power input maximum for use with the equipment. Using that information, the equipment manufacturer may generate a fan curve with software, or look up existing fan curves, and select a specific fan that meets the criteria with the maximum amount of flow (i.e., CFM). Fan curves typically have an X-axis of airflow (CFM) and a Y-axis of static pressure. Multiple curves may be shown per plot, with each curve representing a specific fan blade angle. Each plot represents a specific fan RPM, input HP, number of blades, diameter, and tip clearance, thus the number of plots possible for a single fan size is seemingly infinite; which is why selection software is typically employed when selecting fans for new equipment designs.

For example, a single fan system having a fan rated at the 0.9 inches of static pressure may output a maximum of 36,000 CFM, while maintaining the design minimum of 0.9 inches of static pressure. Increasing the rotational speed of the single fan system will result in an increase in CFM output and required HP input power, however, because the static pressure drops below the 0.9 inch minimum at air flows higher than 36,000 CFM, the system would cause a thermal de-rate in the equipment rather than achieving the goal of a thermal increase. If the airflow of that fan is increased, the fan would be running "off the curve" meaning that the fan is no longer operating at the design point of maximum airflow at the 0.9 inches of static pressure.

There are at least two common methods of increasing the airflow of an existing fan system. A first method is to increase the RPM at the expense of input power (HP). If input power (HP) is unable to be increased, a second method is to re-pitch (e.g., changing the blade angle) the fan blades to increase airflow, at the expense of static pressure regardless of whether the RPM is increased or left constant. However, by using a pair of contra-rotating axial fans, a user can achieve, as an example, 39,000 CFM with 1.25 inches of static pressure at the same RPM as the previous example, thus providing an additional 3,000 CFM and a static pressure surplus of 0.35 (i.e., air horsepower). The 39,000 CFM at 1.25 inches of static pressure would be performance based on a fan manufacturer fan curve generated by software or through actual wind tunnel data.

However, the data used in the above examples represents only one solution. For example, the contra-rotating system may produce 45,000 CFM at the same 0.9 static pressure or conversely the same 36,000 CFM at 1.5 inches of static. Indeed, an objective of these examples is to illustrate that the contra rotating axial fan system extends the design palette of a given axial fan design on both the X-axis (flow) and Y-axis (static). Co-rotating fans expand the design palette single dimensionally on the X-axis of airflow only making it extremely limited in possible applications as compared to the contra-rotation 2 dimensional expansion.

Increasing the HP input of a fan system with an extended fan curve design palette (e.g., using a contra-rotating system) enables a WET/DRY cooling equipment manufacturer to achieve performance beyond that of a single, or even a multi-stage, co-rotating axial fan system. Thus, the contra-rotating system yields unmatched performance that generates unprecedented equipment thermal efficiencies.

Surplus static pressure is particularly beneficial with multi-cell, counter-flow induced-draft units as the intermediate cells experience large thermal de-rates associated with an air HP deficiency with a higher minimum static pressure requirement than the end cells. This may be attributed to the intermediate cells competing for outside air with the cells they are sandwiched between, while the end cells have the luxury of not having to compete for air on one full face of the four-sided air intake.

This contra-rotating fan system mitigates, or removes, the thermal de-rate in the affected cells by properly utilizing and applying its ability to create a large surplus of static pressure, a.k.a. air HP, across the cells in a manner that allows each cell to draw the same amount of intake air.

Turning now to the figures, FIG. 1*a* illustrates a first exemplary embodiment of a first contra-rotating fan drive system 100*a* for WET/DRY cooling equipment. The contra-rotating fan drive system 100*a* can include a first fan 102 and a second fan 104, which may be disposed in an air conduit 106. Air conduit 106 may be in fluid communication with the interior of the WET/DRY cooling equipment unit 120 and the exterior environment. The first and second fans 102, 104 and air conduit 106 may be provided in any location on a WET/DRY cooling equipment unit 120 that enables system 100*a* to function as described herein. In some exemplary embodiments, air conduit 106 may be an exhaust air conduit, for example, an induced-draft cooling unit. In other exemplary embodiments, air conduit 106 may be an intake air conduit, for example, a forced-draft cooling unit. Air conduit 106 may also function as a fan cowl for first and second fans 102, 104.

The first fan 102 and second fan 104 may be axial fans and may be arranged coaxially with respect to each other. In some exemplary embodiments, first and second fans 102, 104 may include removable airfoil-type blades, which, as illustrated in FIG. 1*d* through 1*e* may be pitched to a desired angle. Moreover, the blades may be pitched such that the blade pitch of first fan 102 may be different from the blade pitch of second fan 104.

A motor 108 may be provided to drive the contra-rotating fan drive system 100*a*. Motor 108 may be an electric motor, or any motor known to one having ordinary skill in the art that enables system 100*a* to function as described herein, and may have any power rating suitable for the particular application of system 100*a*. Motor 108 may drive an output shaft 110 on which a drive pulley 112 is mounted. Drive pulley 112 may engage a belt 114, which can in turn engage a driven pulley 116 that is coupled to an input shaft 312 of transmission 200.

An operator may change the ratios of the fan drive system 100*a* by adjusting the size (e.g., diameter) of drive pulley 112 and driven pulley 116. If the belt drive ratio is greater than 1:1, then the fan drive system may be classified as a double reduction fan drive system and the ratio for the belt drive would be multiplied by the transmission drive ratio to determine the "final fan drive ratio"; conversely an overdriven reduction fan drive system is achieved when the belt drive ratio is less than 1:1 (i.e., "overdrive").

Employing a contra-rotating transmission design enables the user to employ alternative gear ratios that are simply not possible with co-rotating fan arrangements, that is, without having to replace the transmission. Thus, the contra-rotating transmission design provides a fully-adjustable, final fan drive ratio in lieu of the existing fixed-transmission ratios that are not field adjustable. Finally, while a belt 114 is illustrated, alternatives means for driving driven pulley 116 would include, for example, chain and sprockets, banded belts, cogged or synchronous belts, power band, cable, and rope.

A support member 130 may be coupled to a WET/DRY cooling equipment unit 120. Motor 108 and transmission 200 may be mounted on support member 130. Motor 108 may be mounted in a substantially, laterally offset position from transmission 200 and oriented such that belt 114 can engage drive pulley 112 and driven pulley 116. Transmission 200 may be mounted proximate air conduit 106 such that the drive shaft 412 can extend upward such that first and second fans 102, 104 are disposed within air conduit 106. A preferred embodiment may use the transmission output shaft in lieu of a drive shaft 412, while alternative embodiments may have a female output sleeve on the transmission to accommodate a drive shaft.

Figure 1B:
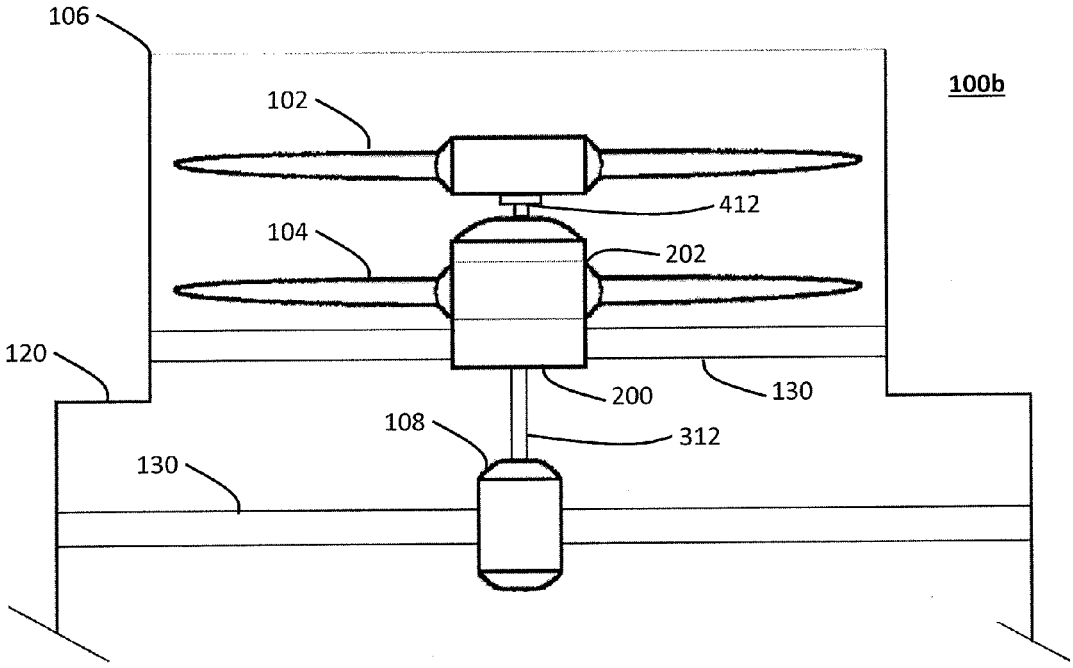
FIG. 1*b* is an exemplary embodiment of a second contra-rotating axial fan system for evaporative cooling equipment.
Figure 1C:
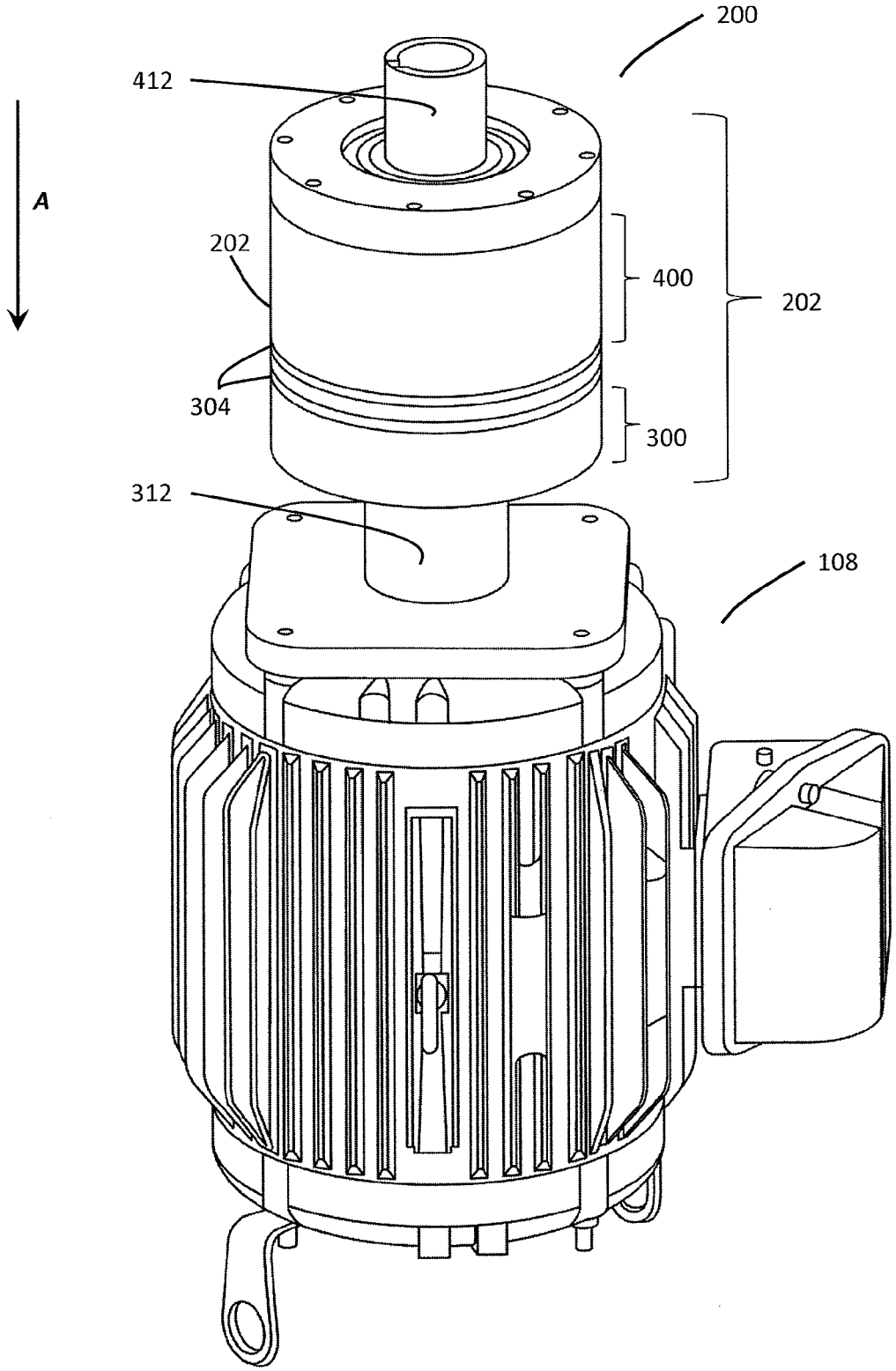
FIG. 1*c* is an exemplary contra-rotating transmission and motor for use with the system of FIG. 1*b*.
Figure 1D:
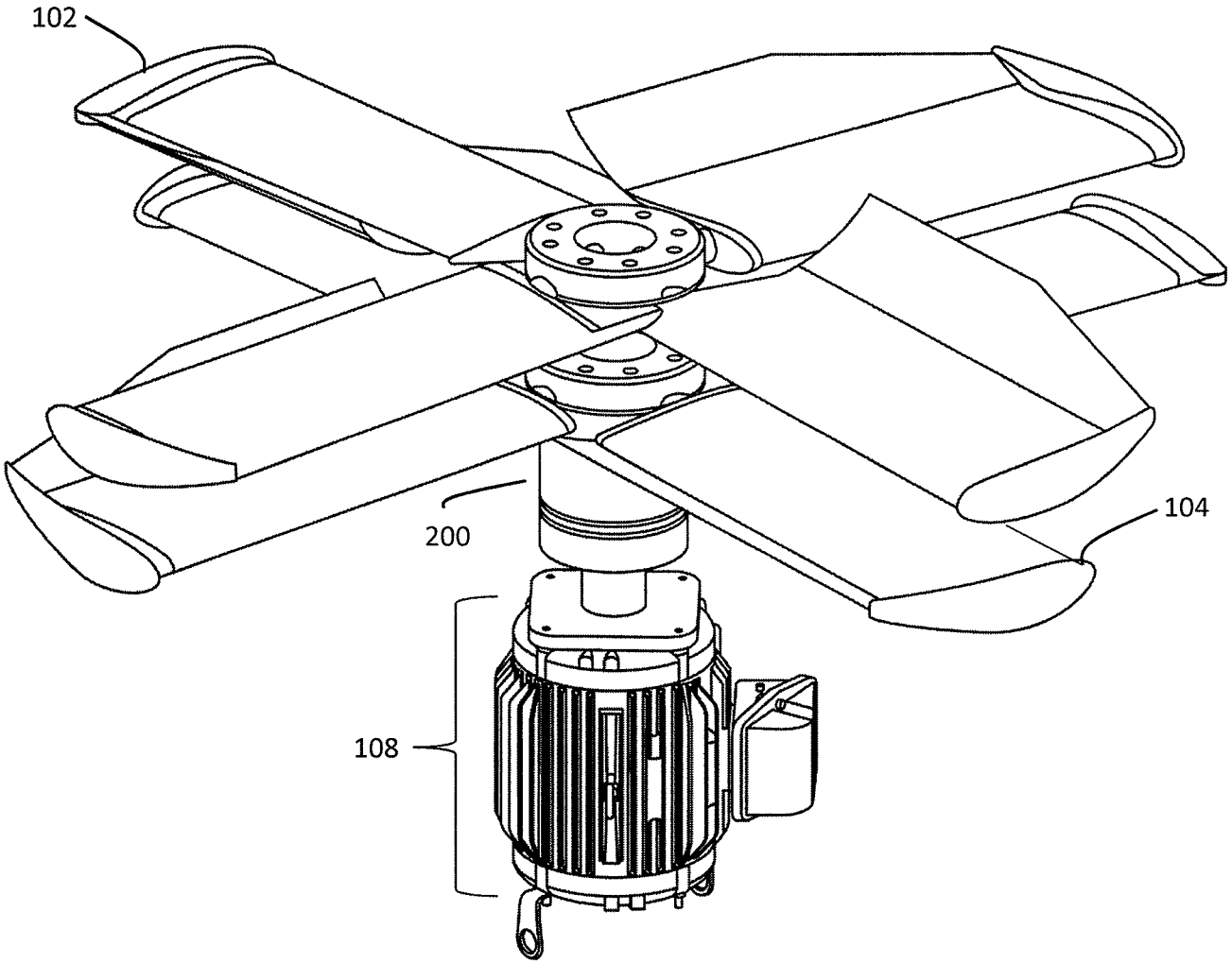
FIG. 1*d* is a first view of an exemplary contra-rotating axial fan assembly for use with the system of FIG. 1*b*.
Figure 1E:
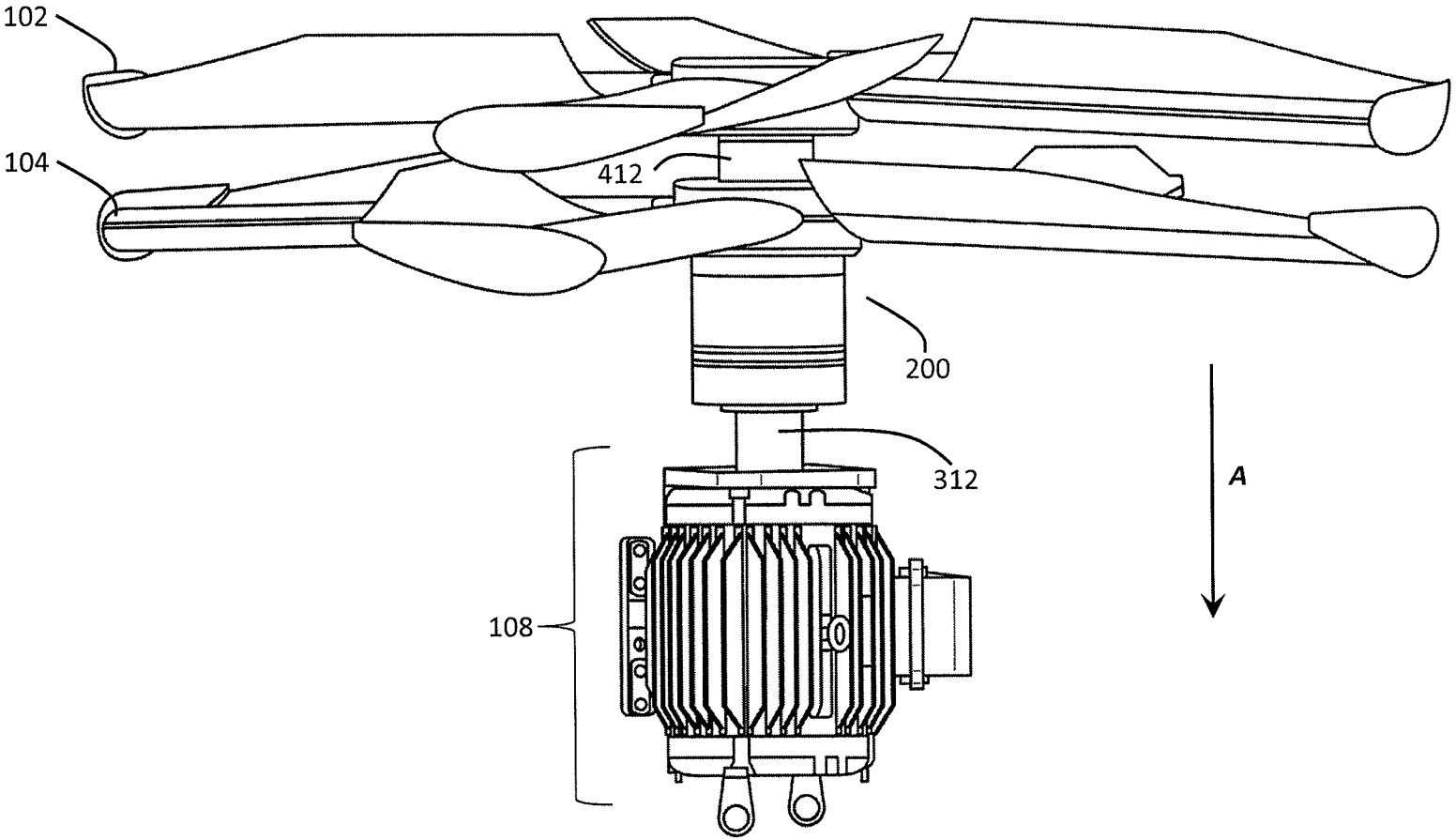
FIG. 1*e* is a second view of the exemplary contra-rotating axial fan assembly for use with the system of FIG. 1*b*.

Alternatively, as illustrated in the drive system 100*b* of FIGS. 1*b* through 1*e*, the motor 108 may be coupled directly to the transmission 200, thereby obviating the need for belts and pulleys. FIGS. 1*c* through 1*e* provide a detailed view of an exemplary contra-rotating fan assembly arrangement for use with the system 100*b*. In yet another embodiment, the motor 108 may be integrated with the transmission 200 to form a singular assembly or component, which is generally known as a "gearhead" motor in the industry.

Referring generally to the drive systems 100*a*, 100*b* of FIGS. 1*a* and 1*b*, transmission 200 may drive first fan 102 via drive shaft 412. First fan 102 may be rigidly coupled to the drive shaft 412, which may be a flanged drive shaft, while second fan 104 may be coupled to a fan hub mounting plate within the transmission 200, which effectively functions as a fan hub when not employing a separate fan hub. The transmission 200 may further comprise a hollow fan driveshaft 202 that encloses the drive internals and serves as a protective sealed drive case in conjunction with the fan hub mounting plate.

Drive shaft 412 and the hollow fan driveshaft 202 may be arranged coaxially with respect to each other such that drive shaft 412 drives first fan 102 and the hollow fan driveshaft 202 drives second fan 104 by way of the fan hub mounting plate. Transmission 200 may include gearing arrangements for rotating the drive shaft 412 and the hollow fan driveshaft 202 at speeds different from the speed of the input shaft 312. As discussed above, transmission 200 may also include internal drive component arrangements that are adapted to drive first fan 102 in a direction counter to that of second fan 104. Furthermore, transmission 200 may be adapted to drive first fan 102 at a different speed than second fan 104.

As is known in the art, power transmission systems, such as presently disclosed contra-rotating transmission 200, typically require lubrication. Normally, oil is introduced to the transmission 200 or transmission system to reduce wear on the various moving parts, while also serving the function of heat dispersion. A problem with oil is that, when two drive assemblies (e.g., upper assembly 400 and lower assembly 300) rotate in opposite directions, the oil is churned to form a foam emulsion. To combat this foam emulsion, a defoamer or an anti-foaming agent may be added; however, due to the high rotational speeds, such defoamers and anti-foaming agents are insufficient in contra-rotating transmissions. For example, contra-rotating transmissions currently used for propulsion in marine and aeronautical applications employ expensive and complicated oiling systems that require frequent maintenance. An oil-free contra-rotating transmission, as disclosed herein, does not require such maintenance, nor does it require frequent overhauls.

Accordingly, the presently disclosed contra-rotating transmission 200 may be lubricated with grease in lieu of oil. Unlike oil, grease does not suffer the drawback of foaming. Indeed, a sealed case and grease lubrication allows for the possibility of a substantially, permanently-lubricated transmission that requires no maintenance for the lifetime of the unit, while conventional gearboxes require regular oil changes. Therefore, according to at least one exemplary embodiment, an oil-free contra-rotating transmission for evaporative cooling equipment is also disclosed. The oil-free contra-rotating transmission disclosed herein can provide a compact, integrated arrangement for varying the rotational speed and rotational direction of first and second axial fans 102, 104.

There are a number of suitable types of grease that may be used in conjunction with the oil-free contra-rotating transmission 200. For example, a biodegradable, food-grade grease and solid lubricants may be used. This reduces the necessity for frequent maintenance of contra-rotating transmission 200, while also reducing the environmental impact of the contra-rotating transmission 200. Furthermore, the oil-free transmission is an environmentally-friendly alternative to conventional gearboxes that require oil changes. Indeed, grease technology has advanced to the point that the development of this transmission as a permanent, lubricated sealed-case unit is feasible. Synthetic grease with an additive package suited for this transmission may be employed to repel water infiltration, dissipate heat, withstand wide temperature range, absorb shock loads, anti-seizing agent, etc. While a synthetic grease solution may not be as environmentally friendly as biodegradable grease, since it is permanently sealed in the case it would be environmentally friendly in that it never needs to be exposed to the outside environment, while eliminating the need for oil changes and generation of waste oil over its lifetime. Permanent, lubricated, sealed ball bearings may be employed to work in conjunction with the special formulated grease.

Figure 2A:
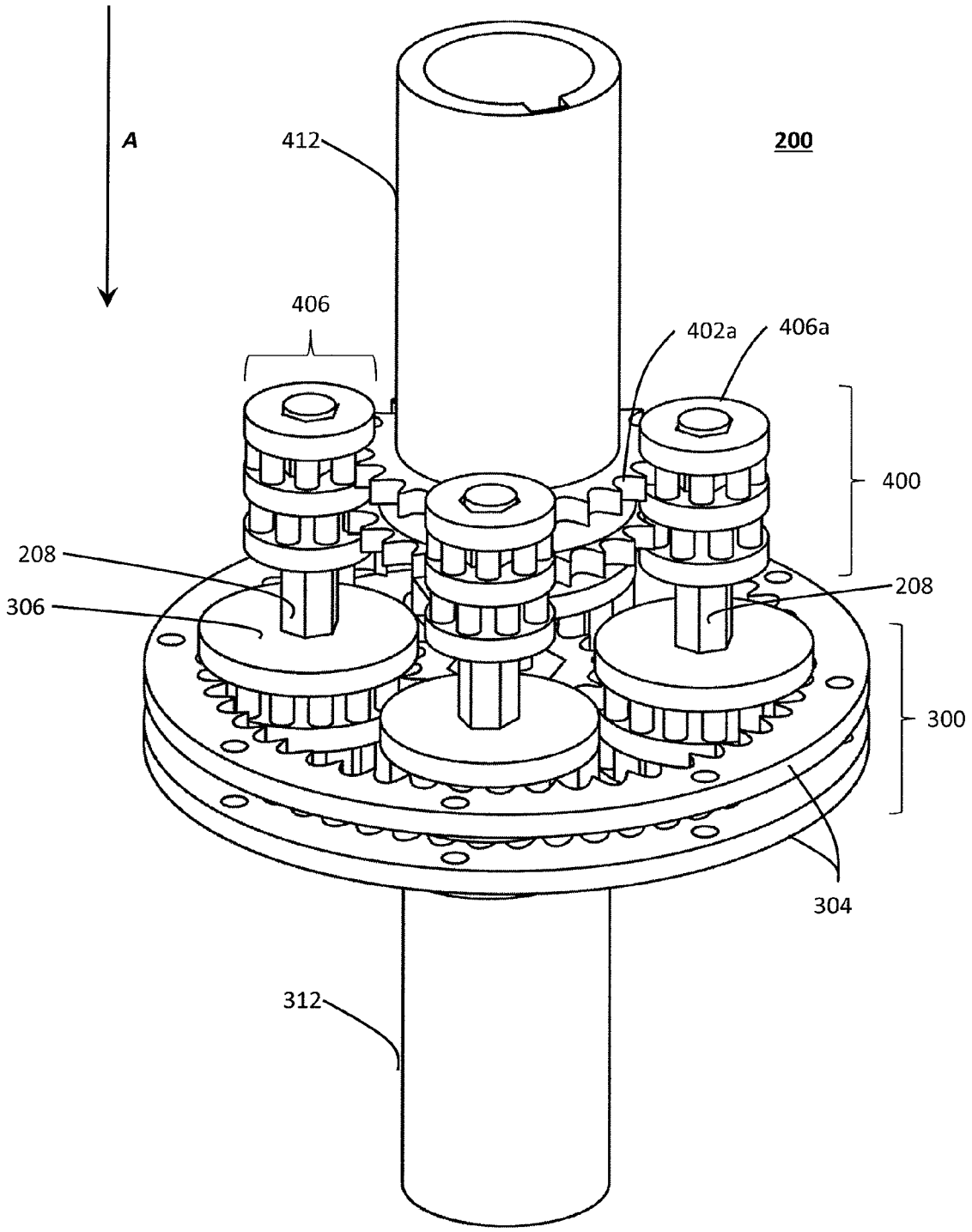
FIG. 2*a* is a front, isometric view of an exemplary embodiment of a contra-rotating transmission for use in a contra-rotating axial fan system.
Figure 2B:
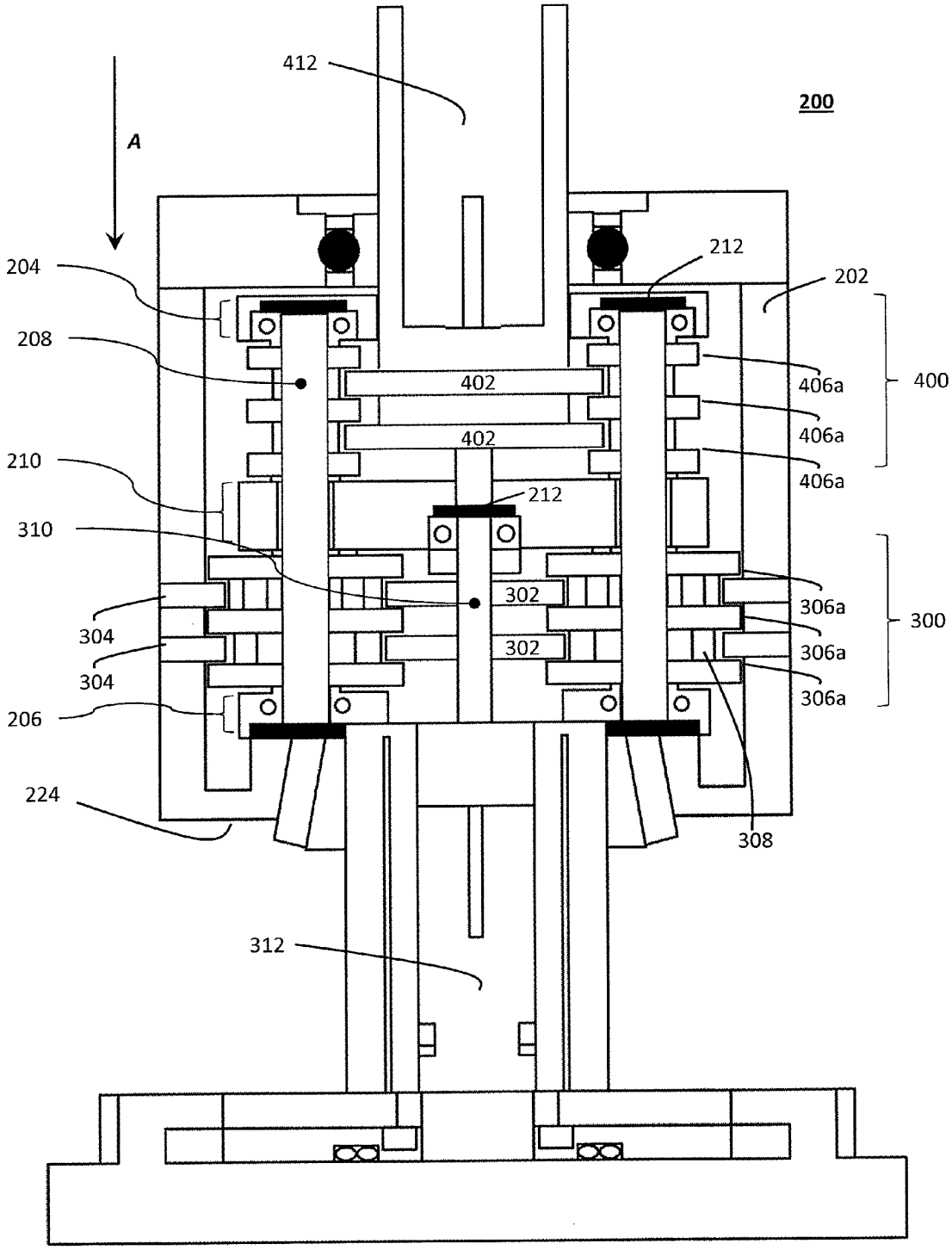
FIG. 2*b* is a side, cross-sectional view of the exemplary embodiment of a contra-rotating transmission.

FIGS. 2*a* and 2*b* illustrate an exemplary embodiment of a contra-rotating transmission 200. Indeed, a contra-rotating transmission 200 may include an upper drive assembly 400 and a lower drive assembly 300. The lower drive assembly 300 may be coupled with an input power source via a transmission input shaft 312. The lower portion of the input shaft 312 may be hollow and designed to receive the output shaft of a power source (e.g., an electric motor) and configured to transfer torque from the input power source to a pinwheel driver 302 (e.g., a center pinwheel driver), which may be operatively coupled to the solid upper portion of the input shaft 312. The torque may then be transferred, via one or more pinwheels, to the upper drive assembly 400. Torque from the input shaft 312 may ultimately be used to rotate two contra-rotating fans 102, 104, which may be operatively coupled with the upper drive assembly 400 and/or lower drive assembly 300. For example the upper drive assembly 400 may be configured to rotate a first fan 102 in a first direction (e.g., clockwise), while the lower drive assembly 300 may be configured to rotate a second fan 104 in a second direction, which may be opposite the first direction (e.g., counter-clockwise). While not illustrated, as is known in the art, one or more thrust washers may be positioned throughout the transmission 200 at the various connection points to reduce any friction and/or to function as spacers. The thrust washers may be fabricated from less corrosive materials, such as brass or bronze.

While FIG. 2*a* illustrates the contra-rotating transmission 200 with the hollow fan driveshaft 202 removed, as illustrated in FIG. 2*b*, the hollow fan driveshaft 202 may serve as a protective casing and may be used to enclose the upper drive assembly 400 and a lower drive assembly 300 of the contra-rotating transmission 200 in embodiments that employ integrated drive assemblies such as illustrated in FIG. 2*a*. For example, the hollow fan driveshaft 202 may be constructed by integrating one or more parts to form a hollow fan driveshaft that ultimately drives second fan 104. For example, the hollow fan driveshaft 202, or portion thereof, may be operatively coupled with the fan hub mounting plate, or, as illustrated herein, the fan hub mounting plate may also be integral with outer pinwheel receiver 304. Thus, as illustrated, the components used to construct the hollow fan driveshaft 202 may include one or more pinwheel receivers 304*a*. The hollow fan driveshaft 202 may be coupled at one end to a hollow driveshaft base 224 to form a sealed casing for housing upper drive assembly 400 and lower drive assembly 300. Moreover, as illustrated in FIG. 2*b*, one or more plates 204, 206, 210 may be provided between the various components or assemblies to increase structural integrity of the transmission 200. The one or more plates 204, 206, 210 may be further configured to receive an end of one or more shafts (e.g., shaft 208) and/or sleeves (e.g., sleeve 310) while permitting the shafts or sleeves to rotate as needed. Indeed, a stop plate 212 may be positioned at the end of each shaft to rotatably secure the distal ends of the one or more shafts and/or sleeves, thereby prohibiting unwanted movement in, or against, direction A.

The hollow fan driveshaft 202 also serves as a protective casing and may be further sealed to protect the components of upper drive assembly 400 and the lower drive assembly 300 from the elements (e.g., weather, dirt, oxidation, moisture infiltration or loss, etc.), thus preserving the lubricant (e.g., grease) inside for a greatly extended useful lifespan. The hollow fan driveshaft 202, or components thereof, may be fabricated from, for example, steel (A36, 1018, 1045, etc.), alloy steel (4130, 4140, 8620, etc.), stainless steel (300 series, 400 series, 600 series, etc.), tool steel (O1, A2, M4, etc.), titanium (grade 2, grade 5, alloy, etc.), aluminum (alloy 6061, alloy 2024, alloy 7075, etc.), cast iron, known metal alloys, powdered metals for sintering (e.g., 3D Printers) or a combination thereof. For example, the hollow fan driveshaft 202, or components thereof, may be fabricated from aluminum alloy 6061 and may be further subjected to additional metal treatments to alter the properties of the metal to meet a specific design parameter or need. For example, the metal may be heat treated with one or more of the following treatments: annealing, case hardening, precipitation, strengthening, tempering, quenching, etc. The metal may also be subjected to surface finishing treatments intended to alter the metal surface properties and appearance to meet specific design parameter or need such as, but not limited to, grinding, polishing, buffing, shot peening, media blasting, plating, anodizing, oxidizing, pickling, acid treating, etc. In certain embodiments, the components of the transmission 200 may be formed from recycled or recyclable materials such as aluminum, steel, iron, other or recycled metals alloys. However, one of skill in the art would understand that other materials may be employed to meet a particular need (e.g., corrosion resistance, weight limitations, strength requirements, etc.). Furthermore, the outer surface of the various components may have a weatherproof coating, chemical application, powder coating, bonded polymer, or similar treatment, and/or be made of or enclosed in a ceramic, plastic, any available non-corrosive material, or corrosion-resistant metal alloy such as aluminum, stainless steel, bronze, or titanium. Moreover, one of skill in the art would understand that two or more different materials may be used to fabricate the various case components.

Figure 3A:
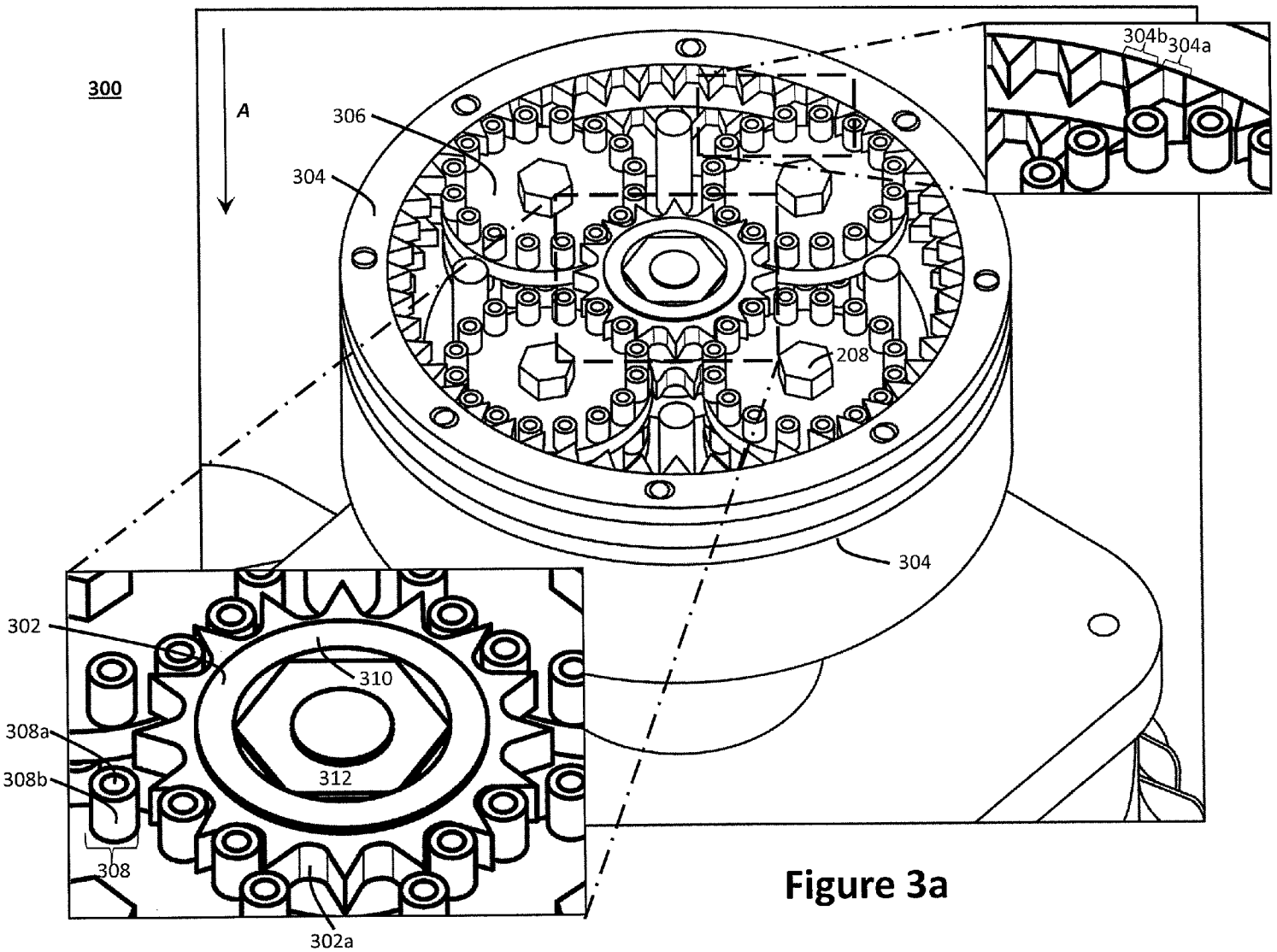
FIG. 3*a* is a front, isometric view of a lower drive unit of the exemplary embodiment of a contra-rotating transmission.
Figure 3B:
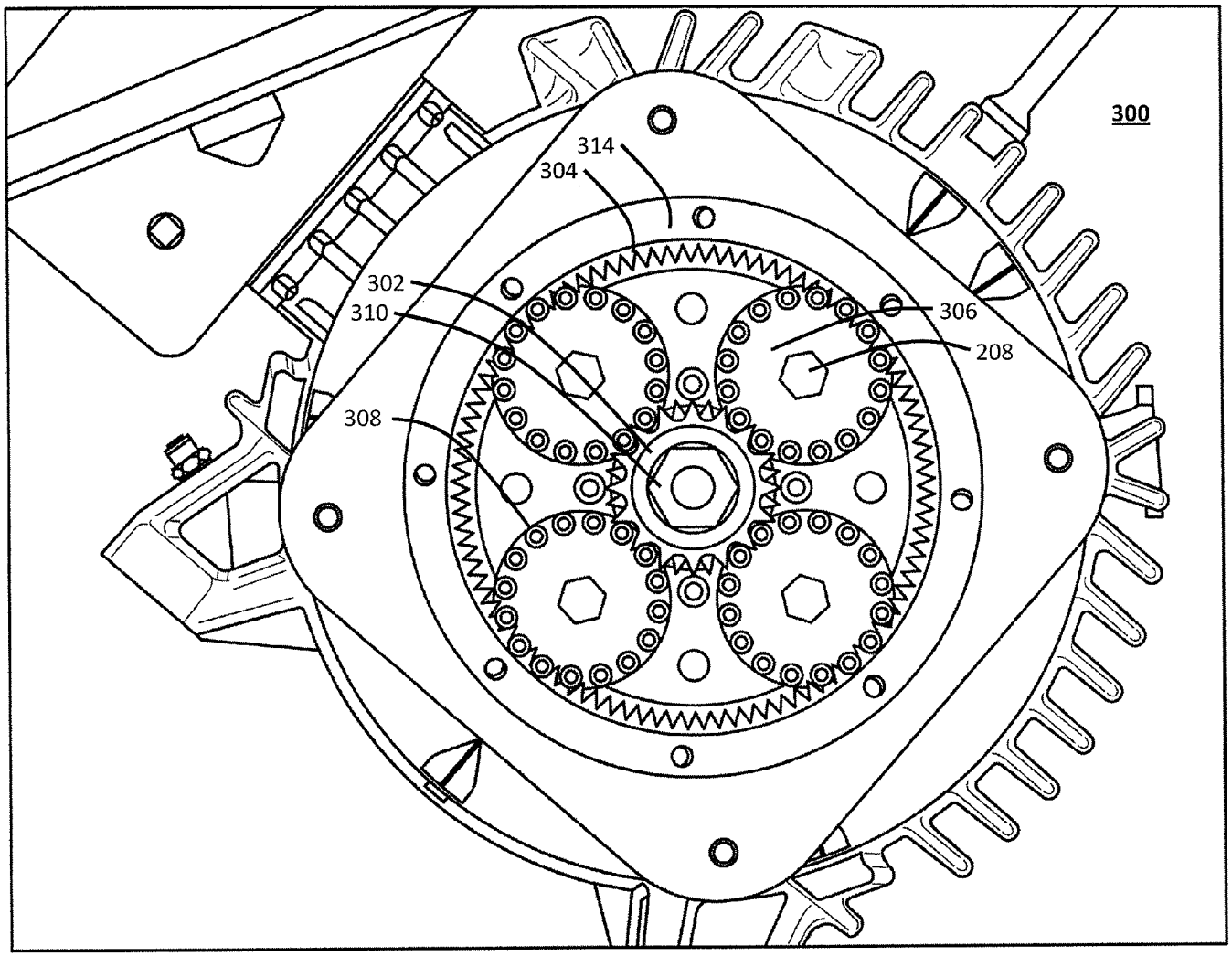
FIG. 3*b* is a top, plan view of the lower drive unit of the exemplary embodiment of a contra-rotating transmission.

Turning now to FIGS. 3*a* and 3*b*, a perspective view and top plan view of the lower drive assembly 300 are illustrated, respectively, with the upper drive assembly 400 removed. As illustrated, the lower drive assembly 300 may comprise a center pinwheel driver 302, a plurality of intermediate pinwheels 306 and an outer pinwheel receiver 304, which may be integrated with, or otherwise coupled to, the hollow fan driveshaft 202. Indeed, the hollow fan driveshaft 202 and the outer pinwheel receiver 304 may be formed as a single component. That is, the inner circumferential surface of the hollow fan driveshaft 202, or portion thereof, may comprise thereon a plurality of pinwheel receiver spacers 304*b*, which define a plurality of gullets 304*a*. For illustrative purposes, the upper pin support plate 306*a* of each intermediate pinwheel 306 has been removed to better depict the plurality of perpendicularly disposed rollers 308.

The various power transmission components (e.g., the pinwheel driver 302, intermediate pinwheels 306, and outer pinwheel receiver 304) may be fabricated from a metal alloy of suitable strength to meet the design loads. The metal alloy may be further subjected to one or more heat treatments and surface treatments to alter the metal physical properties, surface, and appearance to meet desired strength, hardness, abrasion resistance, appearance, corrosion resistance, shock resistance, surface smoothness, etc. However, one of skill in the art would understand that other materials may be employed to meet a particular need (e.g., corrosion resistance, weight limitations, strength requirements, etc.). For example, the outer surface of the various components may have a weatherproof coating, chemical application, powder coating, bonded polymer, or similar treatment, and/or be made of or enclosed in a ceramic, plastic, any available non-corrosive material, or corrosion-resistant metal alloy such as aluminum, stainless steel, bronze, or titanium. Moreover, one of skill in the art would understand that different materials may be used to fabricate the various power transmission components.

As illustrated, the outer pinwheel receiver 304 and pinwheel driver 302 may each comprise a plurality of gullets 302*a*, 304*a* (e.g., female components). Center pinwheel driver 302 may further comprise a sleeve 310 for receiving an end of the input shaft 312. The sleeve 310, to prevent slippage and/or rotation, may be sized and shaped to receive a correspondingly sized and shaped input shaft 312. For example, as illustrated the end of the input shaft 312 and/or sleeve 310 may be a polygon (e.g., stars, triangular, square, pentagonal, hexagon, etc.), oval, semicircle, asymmetrically-shaped, etc. In certain embodiments, sleeve 310 may include a notch (keyway) that can be aligned with a corresponding notch (keyway) on the input shaft 312, so as to create a space of the same shape and dimension as a piece of metal stock (key) to be inserted into the aligned notches (keyways) in order to fix the rotation of center pinwheel driver 302 to the input shaft 312. In fact, the various shafts, axles and the like, or at minimal the ends thereof may employ similar techniques to prevent slippage and/or rotation of the various pinwheels, pinwheel drivers, and pinwheel receivers. For example, the various shafts are illustrated as being hexagonal where coupled to the pinwheels, pinwheel drivers, and pinwheel receivers.

In other exemplary embodiments, center pinwheel driver 302 may be coupled to the input shaft 312 in any suitable manner. For example, the motor 108 may be integrated with the transmission 200 to form a combination motor/contra-rotating transmission apparatus. A combination apparatus could reduce on site assembly time and reducing materials by omitting the need for coupling between the motor/transition.

As noted above, and as illustrated herein, one or more outer pinwheel receiver 304 may be integrated with one or more components (e.g., pinwheel receiver spacers 304*b* and hollow fan driveshaft base 224) as a component used to construct the hollow fan driveshaft 202. For example, outer pinwheel receiver 304 can be coupled to hollow fan driveshaft 202, or portion thereof, that is coupled to a fan hub mounting plate. To that end, outer pinwheel receiver 304 transfers torque from pinwheels 306 through the hollow fan driveshaft 202 of which it is integrated with, which in turn transfers torque to the fan hub mounting plate that enables contra-rotating transmission 200 to function as described herein. To that end, outer pinwheel receiver 304 as part of the hollow fan driveshaft 202 that ultimately drives the fan hub mounting plate may include support coupling structures, which may be any coupling structure that enables the contra-rotating transmission 300 to function as described herein. For example, coupling structures can be threaded bores that can receive a bolt or other threaded fastener. In certain embodiments, fan blades may be coupled (e.g., bolted) directly to fan hub mounting plate, or hollow fan driveshaft 202, which effectively functions as a fan hub.

In the illustrated example, the pinwheel driver 302 engages a first set of four intermediate pinwheels 306, which are fixed in place via pinwheel drive shafts 208, but rotates their respective drive shafts about their axis in the opposite direction of rotation as that of the pinwheel driver 302, while simultaneously engaging the hollow fan driveshaft 202 via the integrated outer pinwheel receiver 304 rotating it in the same direction as the pinwheels 306. That is, the four intermediate pinwheels 306 simultaneously transfer and divide the torque from the pinwheel driver 302 to the hollow fan driveshaft 202 via the outer pinwheel receiver 304 and the upper drive assembly via the pinwheel drive shafts 208. Indeed, pinwheel drive shaft 208 may be rotatably secured in place at its distal ends. Examples include, but are not limited to, the use of ball bearings, bushings, sleeves, blind holes with proper clearance, etc., each of which may be located and secured in the upper housing plate 204 and lower housing plate 206. While four intermediate pinwheels 306, 406, are illustrated throughout, one of skill in the art would understand that greater or fewer intermediate pinwheels 306, 406 may be used. For example, additional intermediate pinwheels may be used to increase robustness by providing additional engagement points. Alternatively, fewer intermediate pinwheels may be used to reduce weight and/or size, or to accommodate a particular casing shape.

Each intermediate pinwheel gear 306 may comprise two or more circular pin support plates 306*a* separated by a plurality of perpendicularly disposed pins 308. The pins 308 may be arranged along the outer circumferences of said two or more pin support plates 306*a* and configured to receive and drive, therebetween, one or more pinwheel receiver spacers 304*b*. Each pin 308 may comprise inner pin 308*a* and a hollow cylinder 308*b*. Indeed, the hollow cylinder 308*b* may be hollow as to provide a space for an inner pin 308*a* such that it is rotationally arranged around said inner pin 308*a*. Thus, in operation, the hollow cylinder 308*b* can rotate around said pin 308*a*, thereby greatly reducing friction between the pinwheels and pinwheel drivers and pinwheel receivers.

While the pins 308 are illustrated as the hollow cylinder 308*b* that can rotate around a pin 308*a*, other embodiments are possible. For example, solid pins without inner pins 308*a* may be recessed into pin support plates 306*a* with blind holes in pin support plates to provide proper clearance to allow pin to rotate in the blind hole. In another alternatively, both inner 308*a* and hollow cylinder 308*b* may be recessed into the pin support plates 306*a* with the inner pin 308*a* recessed further so as to allow the hollow cylinder 308*b* to rotate around the inner 308*a*. Finally, solid pins 308 with no inner pins 308*a* may be recessed into pin support plates with the pin fixed into a tight blind hole with no clearance and unable to rotate.

While outer pinwheel receiver 304 and pinwheel driver 302 are illustrated and described as being female, with the intermediate pinwheels 306*a* being male, the opposite arrangement may be employed. That is, the outer pinwheel receiver 304 and/or pinwheel driver 302 may be replaced with pinwheels of the same diameter and corresponding number of pins as there were gullets and the intermediate pinwheels 306 may be replaced with a pinwheel idler of the same diameter and corresponding number of gullets as there were pins.

Notably, the gearing may be multi-phased, or more specifically, as illustrated, dual-phased. That is, each drive component may comprise two or more offset layers of gullets 302*a*, 304*a* and/or pins 308, wherein the two or more layers are offset by rotating each layer by a predetermined number of degrees with respect to the preceding layer. For example, in the illustrated dual-phased arrangement, the outer pinwheel receiver 304 and pinwheel driver 302 may be fabricated with two offset, but otherwise identical, gullet profiles 302*a*, 304*a* separated by a gap or spacers 304*b*. Similarly, each intermediate pinwheel 306 may be fabricated from three pin support plates 306*a*, having a layer of pins 308 sandwiched between each pin support plate 306*a*. As illustrated, a dual-phased offset pinwheel driver/receiver may be phased in a manner such that a gullet of the first layer aligns at the exact midpoint between the gullets of the second layer.

By offsetting two layers, the number of rollers 308 and/or gullets 302*a*, 304*a* in a given wheel diameter can be effectively doubled. This increases the points of contact between the power transmission components within the transmission, allowing for a denser power distribution within the transmission. Correspondingly, in a tri-phased arrangement (i.e., three layers), the number of rollers 308 and/or gullets 302*a*, 304*a* in a given wheel diameter can be effectively tripled, while it is quadrupled in a quad-phased arrangement (i.e., four layers). Thus, the greater the number of phases, the denser power distribution within the transmission.

A denser power distribution significantly lowers the power being transferred at each point of contact thus significantly increasing the capacity rating of the transmission. The increased power density also allows for the overall size of the transmission to decrease as compared to single phased transmissions of same capacity. The denser power distribution within the transmission also allows for an increased ability in withstanding shock loads, which is one of the most common failure points of conventional transmissions and gearboxes. The presently disclosed pinwheel design provides the ability to withstand shock loads; however, by multi-phasing the pinwheel design, the shock load resistance is substantially increased further. For example, in a dual-phase arrangement, at no time during the 360 degree rotation of the input shaft 312 is there a loss of engagement between the pinwheels and the pinwheel drivers/receivers; in fact, the level of engagement is greater than that of a single phase design across the entire 360 degree span of rotation.

An advantage of increasing pin engagement is its effect on backlash. That is, in this case, the amount of travel in degrees that the input shaft 312 may be rotated in reverse direction before the output shaft 412 (or hollow fan driveshaft 202) begins to rotate. This is commonly described as "slop" or "play" and it is the result of gaps present between the moving parts that engage inside the transmission. These gaps are present for an infinite multitude of reasons and in most cases are required for reasons such as lubrication allowance, thermal expansion allowance, jam prevention, etc. In fact, the utilization of multi-phased pinwheels in the contra-rotating transmission 200 virtually eliminates backlash due to the high number of pins engaged during all 360 degrees of input shaft 312 rotation. This can facilitate greatly reducing or completely eliminating the likelihood of generating shock loads, in the event that the input shaft rotation were to be suddenly reversed while in motion. For example, "wind milling", a common problem for gear driven WET/DRY cooling equipment with no anti-reversing measures, where the fans are being driven in one direction by an outside force such as wind and then the power input to the transmission is turned on, suddenly reversing the rotation of the fans. In some exemplary embodiments, contra-rotating transmission 200 may further include a locking mechanism, so as to allow a particular fan to spin in one direction while impeding the fan from spinning in the reverse direction to prevent condition such as "wind milling".

Multi-phasing also serves to transfer power from the motor in a more diffuse way by not concentrating the loads on the pins that are engaged. Continuing with the prior example, when four intermediate pinwheels 306 are employed in a dual-phase arrangement, the power is evenly distributed across the four pinwheel engagement points, times two layers, because substantial pin engagement is achieved through the entire 360 degrees of rotation (i.e., irrespective of the rotational position of the gear system). Thus, when, for example, 1 horsepower (HP) is applied at the input shaft, each pinwheel is required to transfer ¼ HP through the pins that are in various stages of engagement times two layers. Conversely, each pinwheel in a single layer system would be required to transfer ¼ HP utilizing half as many pins in various stages of engagement, thereby increasing the force applied to each individual pin, increasing abrasion force (wear and tear), increasing heat generation, and lowering the overall capacity of the pinwheel itself. Finally, a dual-phase arrangement further enables operators to construct a more compact unit while yielding the same efficiency because the input power can be more densely distributed through the gearing system.

The number of gullets 302*a*, 304*a* and pins 308 may be adjusted to achieve a particular gearing ratio as desired by one having ordinary skill in the art. The spacing from center to center of the pins and gullets is known to those skilled in the arts as pitch. As is generally known in the art, the pitch is a value that has direct implications to pinwheel engagement, transmission longevity, overall transmission backlash, etc. Final drive ratio (i.e., the number of revolutions of transmission input shaft: 1 revolution of pinwheel output shaft) is determined by dividing the number of gullets of the pinwheel receiver by the number of pins in a pinwheel for the upper drive assembly 400. For the lower drive assembly 300, the final drive ratio is determined by dividing the number of gullets of the pinwheel receiver by the number of pins in a pinwheel and then subtracting 1 revolution.

Moreover, while a dual-phase arrangement is illustrated throughout, one of skill in the art would understand that greater or fewer phases, or layers, may be used. Alternatively, a single layer may be used to reduce cost, weight and/or size. For example, additional layers may be added to increase robustness by providing additional engagement points. However, the phase will be shifted to accommodate the additional layer. Indeed, the following equation may be used to yield the degree of rotation each subsequent layer is to be rotated from previous layer:

$$\text{Degree Of Rotation Each Subsequent Layer} = \left(\frac{\left(\frac{360\text{ degree}}{No.\ \text{Layers}}\right)}{No.\ \text{Pins/Gullets}}\right)$$

For example, referring to the system illustrated in FIG. 3*a*, the second layer of the intermediate pinwheel 306 and the pinwheel driver 302 is rotated by 11.25 degrees because each dual phased with 16 pins or gullets.

$$11.25\text{ Degrees} = \left(\frac{\left(\frac{360\text{ degree}}{2\text{ Layers}}\right)}{16}\right)$$

Conversely, the second layer of the outer pinwheel receiver 304 is rotated by 3.75 degrees because it is dual phased with 48 gullets.

$$3.75\text{ Degrees} = \left(\frac{\left(\frac{360\text{ degree}}{2\text{ Layers}}\right)}{48}\right)$$

Figure 4A:
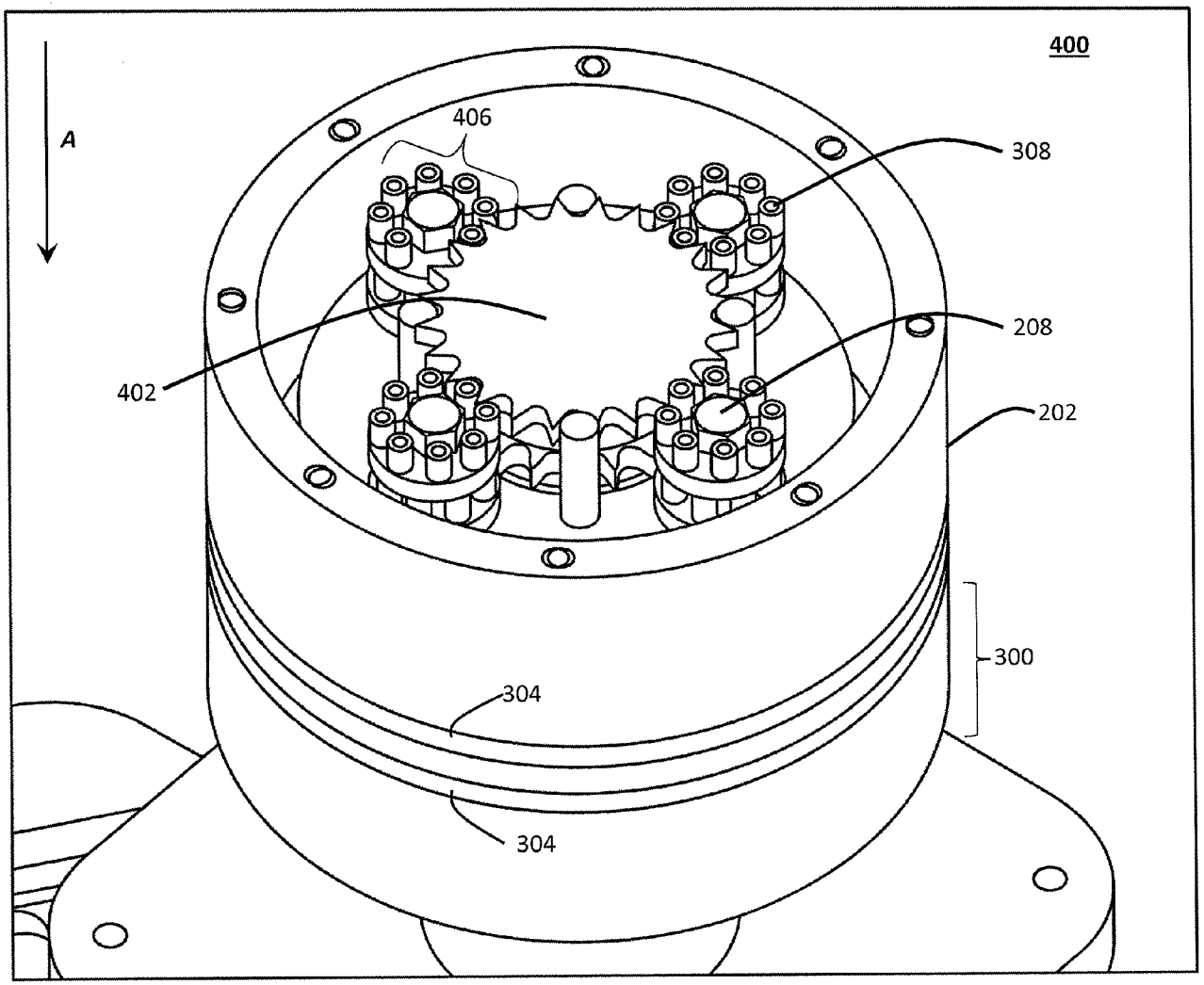
FIG. 4*a* is a front, isometric view of an upper drive unit of the exemplary embodiment of a contra-rotating transmission.
Figure 4B:
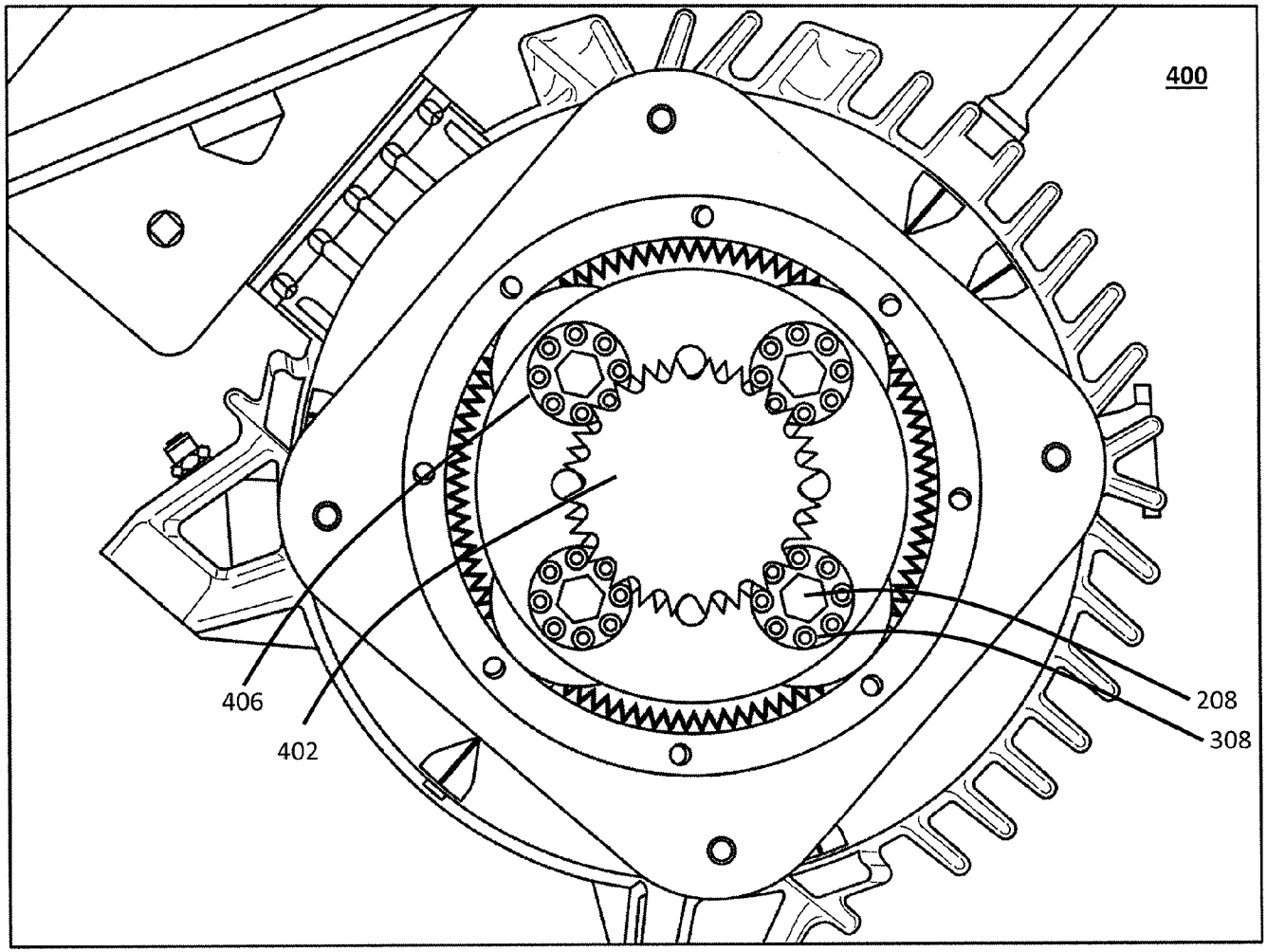
FIG. 4*b* is a top, plan view of the upper drive unit of the exemplary embodiment of a contra-rotating transmission.

Turning now to FIGS. 4*a* and 4*b*, a perspective view and top plan view of the upper drive assembly 400 is illustrated atop, and operatively couple with, the lower drive assembly 300. For convenience of illustration, substantially similar functional elements to those in the lower drive assembly 300 are represented by similar numerals, with the leading digit incremented to 4. As illustrated, the upper drive assembly 400 may comprise a center pinwheel receiver 402, and a plurality of intermediate pinwheels 406. For illustrative purposes, the upper pin support plate 406*a* of each intermediate pinwheel 406 has been removed to better show the plurality of perpendicularly disposed pins 308.

As illustrated in, for example, FIGS. 2*a* and 2*b*, the center pinwheel receiver 402 may be integrated with output shaft 412, which may be configured to rotate opposite hollow fan driveshaft 202. The output shaft 412 may be configured to receive a fan hub. For example, the output shaft 412 may be flanged, male, keyed male, female, female keyed, etc. Alternatively, the fan hub may be integrated with to the output shaft 412 such that fan blades can be fixed directly to output shaft 412 in manner that the output shaft 412 functions as a fan hub.

As discussed with respect to the lower drive assembly 300, the drive assembly may be multi-phased, or more specifically, as illustrated, dual-phased. Similarly, as discussed above, the number of gullets 402*b*, 404*b*, and pins 308 may be adjusted to achieve a particular gearing ratio as desired by one having ordinary skill in the art.

The operation of the contra-rotating transmission 200 will now be described. All rotational directions (e.g., clockwise and counter-clockwise) will be described as viewed in direction A. That is, as viewed from the top (e.g., as illustrated in FIGS. 3*b* and 4*b*). In operation, torque may be applied to the input shaft 312 in the clockwise direction via a motor 108. Torque is then transferred from the input shaft 312 to the center pinwheel driver 302, which similarly rotates in the clockwise direction. In the illustrated example, the center pinwheel driver 302 engages a first set of four intermediate pinwheels 306, which are fixed in place via pinwheel drive shafts 208, but rotate their respective drive shafts 208 about their axis in the counter-clockwise direction while simultaneously engaging the hollow fan driveshaft 202 via the integrated outer pinwheel receiver 304 rotating it counter-clockwise. A discussed above, a second fan 204 may be coupled, directly or indirectly, to the outer pinwheel receiver 304 via hollow output shaft 202 and/or fan hub mounting plate such that the second fan 104 also rotates in the counter-clockwise direction. For example, fan blades may be coupled to the hollow output shaft 202 or the fan hub mounting plate.

In addition to driving the outer pinwheel receiver 304, the first set of four intermediate pinwheels 306 drive a second set of four intermediate pinwheels 406 via their respective drive shafts 208, which extend from the lower assembly 300 to the upper assembly 400, as best illustrated in FIGS. 2*a* and 2*b*. For example, the drive shafts 208 to which the first set of four intermediate pinwheels 306 are attached may be extended to also serve as the drive shafts 208 for the second set of four intermediate pinwheels 406 attached in the same or similar manner. As a result, first and second set of four intermediate pinwheels 306, 406 rotate coaxially in the counter-clockwise direction at the same rotations per minute (RPM).

While the same RPM is output to both sets of pinwheels 306, 406, differing number of pins 308 and/or pitch diameters may be used to change the speed of subsequent gearing. For example, the first set intermediate pinwheels 306 may employ pinwheels having 16 pins 308 while the second set intermediate pinwheels 406 may employ pinwheels having 8 pins 308. As a result, each set of pinwheels 306, 406 can drive their respective pinwheel receivers 304, 402 at different RPMs while rotating at same RPM via the common drive shafts 208.

The second set of four intermediate pinwheels 406 engage the center pinwheel receiver 402, which rotates in the clockwise direction. The center pinwheel receiver 402 may be operatively coupled and/or fully integrated with a fan output shaft 412, which may then be configured to drive a first fan 102 in the clockwise direction. As a result, the second fan 104 rotates in the counter-clockwise direction while the first fan 102 rotates in the clockwise direction.

For a dual-phased arrangement transmission 200 operating fans, which can range from 40 to 156 inches in diameter. (3.5-14 feet) with 20 HP at the input shaft 312, the pinwheel receiver may be approximately 7 inches in overall diameter, the intermediate pinwheels 306 and the center pinwheel driver 302 may be approximately 2 inches in overall diameter. Upper pinwheels may be, for example, approximately 1 inch in overall diameter while the upper center pinwheel receiver may be approximately 3 inches in overall diameter. However, as one of skill in the art would recognize, these values may be adjusted to meet a particular need or durability.

Each layer of the dual-phased arrangement may be, for example, 5/16 inches thick. Though, when a single-phased arrangement is employed, the system may be limited to 10 HP at the input shaft to not exceed capacity ratings based on the strength of the materials being used. That is, the dual-phased arrangement allows for twice the power transmission capacity for the contra-rotating transmission 200.

The presently disclosed contra-rotating transmission 200 may be employed in cooling towers having horsepower ranges typically from 1 to 250 HP. For example, the presently disclosed contra-rotating transmission may be employed in more traditional packaged cooling towers which have typical motor ranges from 1 to 100 HP. More recently, 100 HP motors have been employed in a desperate attempt to generate more capacity. However, using the present system and transmission, only a 60 HP motor is required to generate the same airflow at the same static pressure.

Similarly, they may be employed in field erected cooling towers that range typically from 50 HP to 250 HP and up. Generally speaking, the presently disclosed contra-rotating transmission may be used to drive fans from, for example, 40 inches up to 40 feet in diameter with cubic foot per minute (CFM) typically in excess of 10,000 CFM. Indeed, in addition to the systems 100*a*, 100*b* of FIGS. 1*a* and 1*b*, the presently disclosed contra-rotating transmission 200 may be used in conjunction with fan drive systems such as those described in commonly owned PCT application number PCT/US2013/070430, which was filed on Nov. 15, 2013, and parent U.S. patent application Ser. No. 13/678,095, filed on Nov. 15, 2012, both of which are hereby incorporated by reference in their entirety.

The foregoing description and accompanying figures illustrate the principles, preferred embodiments and modes of operation of the invention. However, the invention should not be construed as being limited to the particular embodiments discussed above. That is, additional variations of the embodiments discussed above will be appreciated by those skilled in the art. Therefore, the above-described embodiments should be regarded as illustrative rather than restrictive. Accordingly, it should be appreciated that variations to those embodiments can be made by those skilled in the art without departing from the scope of the invention as defined by the following claims.

All documents cited herein, including journal articles or abstracts, published or corresponding U.S. or foreign patent applications, issued or foreign patents or any other documents are each entirely incorporated by reference herein, including all data, tables, figures and text presented in the cited documents.

What is claimed is:

1. A contra-rotating fan system for evaporative cooling equipment comprising:

a first axial fan;

a second axial fan arranged coaxially with the first axial fan; and a transmission, the transmission comprising (a) a lower drive unit having a first drive assembly with a first predetermined drive ratio and (b) an upper drive unit having a second drive assembly with a second predetermined drive ratio, wherein the first drive assembly comprises a center pinwheel driver, an outer pinwheel receiver, and a plurality of intermediate pinwheels, wherein the lower drive unit is operatively coupled to a motor, the lower drive unit being configured to (i) drive the upper drive unit, and (ii) rotate the first axial fan at a first speed of rotation in a first direction, wherein the upper drive unit is configured to rotate the second axial fan at a second speed of rotation in a second direction, wherein the direction of rotation of the first direction is opposite to the direction of rotation of the second direction.

2. The contra-rotating fan system of claim 1, wherein the first speed of rotation is different from the second speed of rotation.

3. The contra-rotating fan system of claim 1, wherein the second speed of rotation is substantially equal to the first speed of rotation.

4. The contra-rotating fan system of claim 1, wherein the second drive assembly comprises a center pinwheel receiver, and a second plurality of intermediate pinwheels.

5. The contra-rotating fan system of claim 4, wherein each of said first plurality of intermediate pinwheels is operatively coupled to a corresponding one of said second plurality of intermediate pinwheels.

6. A contra-rotating fan system for evaporative cooling equipment, comprising:

a lower drive unit, said lower drive unit comprising a center pinwheel driver, an outer pinwheel receiver, and a first plurality of intermediate pinwheels; and an upper drive unit, wherein the lower drive unit is operatively coupled to a motor and is configured to (i) drive the upper drive unit, and (ii) rotate a first axial fan in a first direction, wherein the upper drive unit is configured to rotate a second axial fan in a second direction, wherein the direction of rotation of the first direction is opposite to the direction of rotation of the second direction.

7. The contra-rotating fan system of claim 6, wherein the upper drive unit comprises a center pinwheel receiver, and a second plurality of intermediate pinwheels.

8. The contra-rotating fan system of claim 7, wherein each of said first plurality of intermediate pinwheels is operatively coupled to a corresponding one of said second plurality of intermediate pinwheels.

9. The contra-rotating fan system of claim 7, wherein said first plurality of intermediate pinwheels and said second plurality of intermediate pinwheels are configured to rotate at the same rotation per minute.

10. The contra-rotating fan system of claim 6, wherein the center pinwheel driver, the outer pinwheel receiver, and the first plurality of intermediate pinwheels are in a dual-phased arrangement.

11. The contra-rotating fan system of claim 10, wherein each phase of said dual-phased arrangement is rotated by a predetermined number of degrees.

12. The contra-rotating fan system of claim 7, wherein the center pinwheel receiver and the second plurality of intermediate pinwheels are in a dual-phased arrangement.

13. The contra-rotating fan system of claim 12, wherein each phase of said dual-phased arrangement is rotated by a predetermined number of degrees.

14. The contra-rotating fan system of claim 6, wherein the speed of rotation of the first axial fan is different from the speed of rotation of the second axial fan.

15. The contra-rotating fan system of claim 6, wherein said first axial fan and said second axial fan are arranged coaxially with respect to one another.

16. The contra-rotating fan system of claim 7, wherein each of said first and second plurality of intermediate pinwheels comprises two or more disks separated by a plurality of perpendicularly disposed rollers.

17. The contra-rotating fan system of claim 16, wherein each of said plurality of perpendicularly disposed rollers comprises an inner pin and a hollow cylinder rotationally arranged around said inner pin.

18. The contra-rotating fan system of claim 6, wherein the contra-rotating transmission is oil-free.

19. A contra-rotating fan system, comprising:

a first axial fan;

a second axial fan arranged coaxially with the first axial fan; and a transmission, the transmission comprising a lower drive unit and an upper drive unit, wherein the lower drive unit comprises a center pinwheel driver, an outer pinwheel receiver, and a plurality of intermediate pinwheels, wherein the lower drive unit is operatively coupled to a motor and is configured to (i) drive the upper drive unit via said plurality of intermediate pinwheels, and (ii) rotate the first axial fan in a first direction, wherein the upper drive unit is configured to rotate the second axial fan in a second direction, which is opposite to the direction of rotation of the first direction.

20. The contra-rotating fan system of claim 19, wherein each of said plurality of intermediate pinwheels comprises two or more disks separated by a plurality of perpendicularly disposed rollers.

* * * * *